US008240161B2

(12) United States Patent
Lifson et al.

(10) Patent No.: US 8,240,161 B2
(45) Date of Patent: Aug. 14, 2012

(54) SUCTION VALVE PULSE WIDTH MODULATION CONTROL BASED ON COMPRESSOR TEMPERATURE

(75) Inventors: Alexander Lifson, Manlius, NY (US); Michael F. Taras, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 621 days.

(21) Appl. No.: 12/307,780

(22) PCT Filed: Aug. 8, 2006

(86) PCT No.: PCT/US2006/030761

§ 371 (c)(1),
(2), (4) Date: Jan. 7, 2009

(87) PCT Pub. No.: WO2008/018862

PCT Pub. Date: Feb. 14, 2008

(65) Prior Publication Data

US 2009/0205349 A1 Aug. 20, 2009

(51) Int. Cl.
*F25B 41/04* (2006.01)
*F25B 49/00* (2006.01)

(52) U.S. Cl. ..... 62/217; 62/226; 62/228.1; 62/259.2

(58) Field of Classification Search ..... 62/217, 62/226, 228.1, 228.3, 230, 259.2; 417/212, 417/298

See application file for complete search history.

(56) References Cited

U.S. PATENT DOCUMENTS

| | | | | |
|---|---|---|---|---|
| 5,226,472 | A * | 7/1993 | Benevelli et al. | 165/263 |
| 6,047,556 | A | 4/2000 | Lifson | |
| 6,206,652 | B1 | 3/2001 | Caillat | |
| 6,449,972 | B2 | 9/2002 | Pham et al. | |
| 6,745,584 | B2 * | 6/2004 | Pham et al. | 62/228.3 |
| 6,931,867 | B2 | 8/2005 | Healy et al. | |
| 2003/0041607 | A1 * | 3/2003 | Baumert et al. | 62/199 |

OTHER PUBLICATIONS

International Preliminary Report on Patentability dated Feb. 19, 2009.

Search Report and Written Opinion mailed on Jan. 25, 2007 for PCT/US06/30761.

* cited by examiner

*Primary Examiner* — Marc Norman

(74) *Attorney, Agent, or Firm* — Carlson, Gaskey & Olds, PC

(57) ABSTRACT

A refrigerant system is provided with a pulse width modulation valve. A compressor temperature is monitored to prevent potential reliability problems and compressor failures due to an excessive temperature inside the compressor. A control changes the pulse width modulation valve duty cycle rate to maintain temperature within specified limits, while achieving the desired capacity, and complying with design requirements of a conditioned environment, without compromising refrigerant system reliability. As the compressor temperature increases, the pulse width modulation valve duty cycle time is adjusted to ensure that adequate amount of refrigerant is circulated through the compressor to cool the compressor internal components.

20 Claims, 1 Drawing Sheet

SUCTION VALVE PULSE WIDTH MODULATION CONTROL BASED ON COMPRESSOR TEMPERATURE

This application is a United States National Phase application of PCT Application No. PCT/US2006/030761 filed Aug. 8, 2006.

BACKGROUND OF THE INVENTION

This application relates to a pulse width modulation control for a suction valve that allows for continuous and precise capacity adjustment to be provided by a refrigerant system in efficient and cost effective manner, and wherein compressor temperature is monitored to determine an optimum duty cycle for the pulse width modulation method from performance, comfort and reliability perspectives.

Refrigerant systems are utilized in many applications such as, for example, condition an indoor environment or refrigerated space. For instance, air conditioners and heat pumps are used to cool and/or heat the air entering an environment. The cooling or heating load in the conditioned environment may change with ambient conditions, internal thermal load generation, and as the temperature and/or humidity levels demanded by an occupant of the environment or requirements for the conditioned space are varied. Therefore, the refrigerant system operation and control have to adequately react to these changes in order to maintain stable temperature and humidity conditions within the environment, while preserving functionality, performance and efficiency as well as sustaining reliable operation.

One method that is known in the prior art to assist in the adjustment of capacity provided by a refrigerant system is the use of a pulse width modulation control. It is known in the prior art to apply a pulse width modulation control to cycle a suction valve at a certain rate for controlling the flow of refrigerant to a compressor, to in turn adjust refrigerant system capacity. Since the pulse width modulation valve is typically cycled between fully open and fully closed (or nearly fully closed) positions, minimal additional throttling or other noticeable performance losses are imposed during such part-load operation. By limiting the amount of refrigerant flow passing through the compressor, the capacity can be reduced to a desired level below a full-load capacity (approximately down to 5% of the total capacity) of a refrigerant system to precisely match the thermal load in a conditioned environment.

One problem raised by pulse width modulation of a suction valve is that a flow of refrigerant delivered into the compressor suction port may be significantly reduced. In many compressor designs, the suction refrigerant passes over the motor, to cool the motor. If the amount of refrigerant flowing through the compressor suction port is significantly reduced, it may not adequately cool the motor. The motor temperatures may increase dramatically and exceed a specified limit that in turn may lead to permanent motor damage and catastrophic failure. Moreover, since a lower amount of refrigerant is relied upon to cool the motor, that refrigerant can become excessively hot and may transfer this heat to other compressor components, overheating these components, including oil lubricating the compressor elements, which is highly undesirable. Also when compressor operates in a pulse width modulation mode, during the portion of the cycle when the pulse width modulation valve is closed or nearly closed, the operating pressure ratio can reach very high values. High pressure ratio operation coupled with excessive motor heat can lead to high discharge temperatures at the compressor discharge or within the compression elements. Thus, if the pulse width modulation technique is setup to cycle through relatively long periods of a suction valve being closed or nearly closed, the compressor components, oil and refrigerant can become extremely hot, leading to potential compressor reliability problems and nuisance shutdowns. Additionally, thermal inertia of a refrigerant system may not be sufficient enough to overcome and prevent temperature and humidity variations in a conditioned environment, causing occupant discomfort or hampering refrigeration.

On the other hand, if the valve is cycled too frequently to minimize the upper temperature excursions, the risk of suction valve failure may increases due to the extensive cycling, as well as secondary instability effects may propagate throughout the system interfering with its proper functionality.

Consequently, there is a need for a method to control a duty cycle for a pulse width modulation valve to eliminate all undesired phenomena mentioned above.

SUMMARY OF THE INVENTION

In a disclosed embodiment of this invention, a pulse width modulation control is provided for selectively varying the amount of refrigerant flow passing from an evaporator downstream to the compressor. By adjusting the amount of refrigerant flowing through a suction valve controlled by a pulse width modulation technique, the capacity provided by the refrigerant system can be continuously and precisely adjusted to match thermal load requirements in a conditioned environment. A control monitors parameters indicative of a compressor temperature, and ensures that the temperature does not exceed a specified limit (within a tolerance band).

The duty cycle of the suction valve controlled by a pulse width modulation method is selected to ensure that the temperature stays below the predetermined limit. In a disclosed embodiment, the temperature associated with compressor temperature is monitored either at the motor, the compressor unit, the discharge tube, at the exit from the compressor pump-set, or any other relevant location. Should the temperature approach the predetermined limit, the pulse width modulation cycling rate of the suction valve is adjusted to a higher value to keep the temperature below the specified limit. Similarly, as long as the temperature is maintained below such a threshold, no adjustment to the valve cycling rate may be required. On the other hand, if the cycling rate (the number of cycles per unit of time) is excessive (for instance, from valve reliability considerations), then the control may lower this rate, while still keeping the measured temperature below the predetermined threshold.

Further, the cycling rate can be also adjusted based upon operating conditions, allowable temperature and humidity variations within a conditioned environment, reliability limitations of the suction valve, refrigerant system efficiency goals, system thermal inertia, operation stability and functionality considerations, etc. Alternatively, some adaptive control can be utilized wherein the control "learns" how variations in the duty cycle will result in changes in the compressor temperature. A worker of ordinary skill in the art would recognize how to provide such a control.

These and other features of the present invention can be best understood from the following specification and drawings, the following of which is a brief description.

DETAILED DESCRIPTION OF THE PREFERRED EMBODIMENTS

Figure 1:
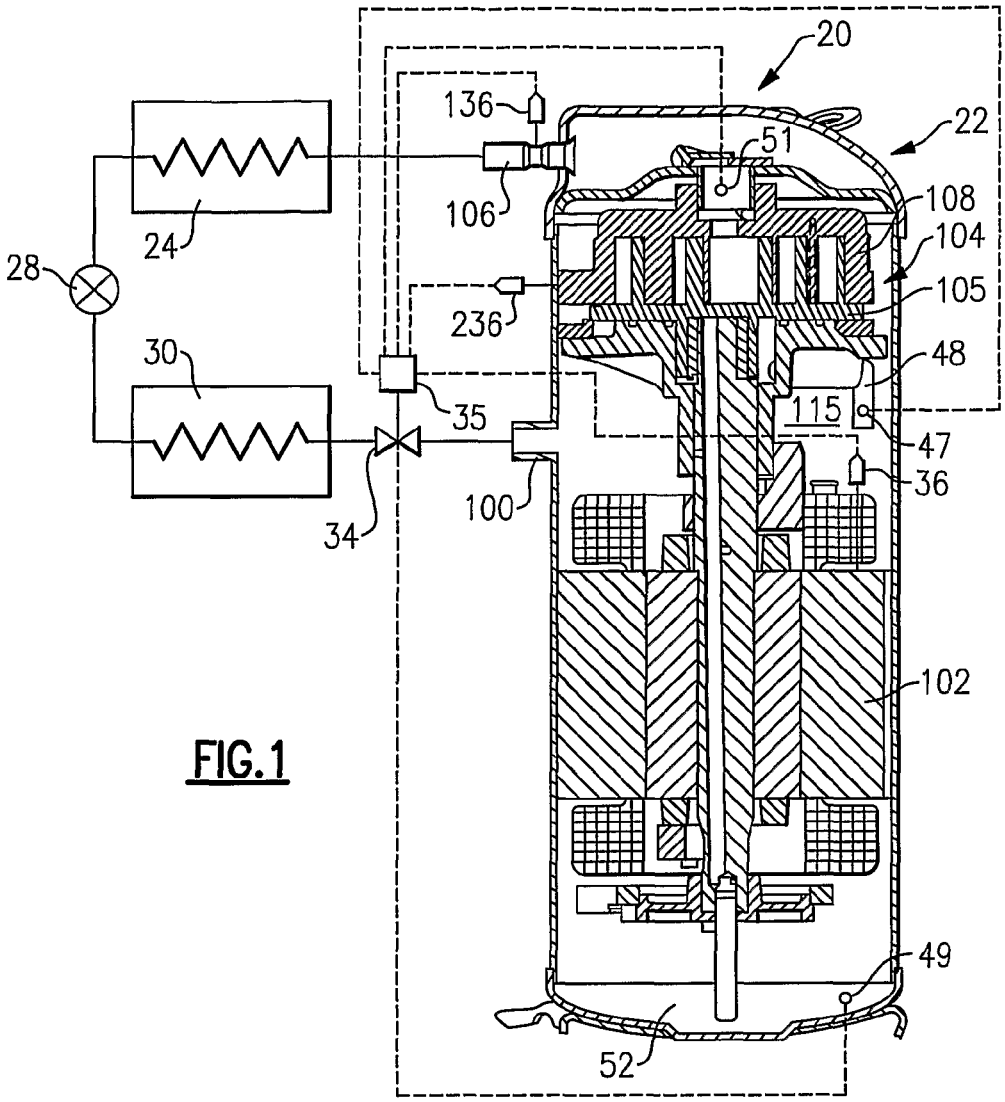
FIG. 1 shows a schematic of a refrigerant system incorporating the present invention.

A refrigerant system 20 is illustrated in FIG. 1 having a compressor 22 compressing a refrigerant and delivering it downstream to a condenser 24. The refrigerant passes downstream to an expansion valve 28, and then to an evaporator 30. A suction valve 34 controlled with a pulse width modulation signal is positioned downstream of the evaporator 30 and upstream of the compressor 22 suction tube 100. A control 35 adjusts and maintains the duty cycle parameters for the suction valve 34 controlled with the pulse width modulation signal.

As shown, a temperature sensor 36 is associated with the motor 102 of the compressor 22. As is known, the refrigerant enters the compressor through the suction tube 100, and flows over the motor 102 driving a compressor pump unit 104. In the disclosed embodiment, the compressor is a scroll compressor including an orbiting scroll member 105, which is driven by the motor 102, and a non-orbiting scroll member 108. Further, a discharge tube 106 receives a compressed refrigerant and delivers it to the condenser 24, as known. Temperature sensor 136 is shown on the discharge tube. Temperature sensor 236 is shown associated with the compressor pump unit 104, and in particular with the non-orbiting scroll 108. Any one of these locations are acceptable locations for providing a temperature feedback to the control 35. Of course, any other locations to measure relevant compressor or refrigerant temperatures are also feasible. For example a temperature sensor can be installed to measure an oil temperature within the compressor sump or to measure the oil temperature as it has been returned back to the compressor sump after it passed through various components within the compressor to cool these components. As shown in FIG. 1, a temperature sensor 47 can be installed near or on the oil return tube 48 that drains the oil back to the compressor sump. Also, a temperature sensor 49 can be installed to measure the oil temperature in the compressor sump 52. Furthermore, the temperature sensor can be installed to monitor temperature within the compression process or positioned immediately after the location where refrigerant leaves the compression elements, as shown by sensor installation 51.

As mentioned above, the refrigerant from the suction tube 100 flows into an internal compressor chamber 115 and then over the motor 102, to cool the motor. However, when the control 35 has closed or nearly closed the valve 34 (during an oil-cycle), the refrigerant flow over the motor is drastically reduced. Since the motor continues to operate, although at a significantly reduced load, it may not be adequately cooled, and its temperature may increase above the allowable limit that in turn may lead to permanent motor damage and catastrophic failure. Moreover, since a lower amount of refrigerant is relied upon to cool the motor, that refrigerant can become excessively hot and may transfer this high temperature heat to other compressor components and oil lubricating the compressor elements, which is highly undesirable. Additionally, when the pulse width modulation valve is closed or nearly closed, a suction pressure at the compressor entrance is very low; this leads to a very high operating pressure ratio (a ratio of a discharge pressure to a suction pressure). High pressure ratio operation coupled with excessive motor heat can lead to high discharge temperatures at the compressor discharge or within the compression elements. The present invention monitors the relevant temperature at a location 36, 136, or 236, or a combination of thereof, and changes the parameters of a duty cycle to ensure that the temperatures associated with the compressor operation will not become excessively high. For purposes of this invention, any of the locations mentioned above, or any other location where a temperature is indicative of the temperature within the compressor, may be utilized. Further, while a scroll compressor is shown, any other type of a compressor may benefit from this invention, such, as for example, a screw compressor, a rotary compressor or a reciprocating compressor.

Figure 2:
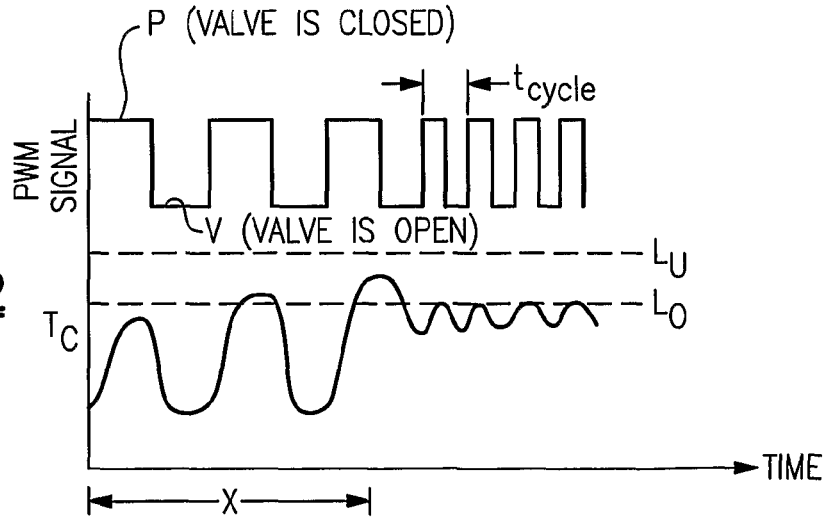
FIG. 2 shows a time versus pressure chart of a pulse width modulation control, including a temperature over time trend.

As shown in FIG. 2, the duty cycle of the suction valve 34 is controlled with a pulse width modulation signal. The pulse width modulation valve 34 is cycled between a closed position (corresponding to a flat peak position "P") and an open position (corresponding to a flat valley position "V"). It should be noted that the suction valve 34 is preferably a normally open valve, so as, in the event of a failure, it stays open and does not compromise system reliability. In a disclosed embodiment, the suction valve 34 is, for instance, a solenoid valve that is capable of rapid cycling. The present invention changes the duty cycle, or the time interval over which the valve is in the open and closed positions.

FIG. 2 also shows a compressor temperature that may be the temperature monitored by any of the sensors of FIG. 1. An upper limit $L_U$ is set. Also, the operational temperature target value $L_O$ may be set, at which system operation is desirable, while not allowing any excursions to exceed the upper Limit $L_U$ The measured temperature is maintained below that limit $L_U$, with a target temperature value to be at $L_O$ or below. As long as the temperature is not exceeding the limit (within the tolerance band defined by the measurement accuracy, manufacturing variability, installation tolerance, etc.), the valve is cycled at a relatively slow rate, while still achieving the desired capacity, complying with temperature and humidity variation requirements in a conditioned environment and not overshadowing the thermal inertia of the refrigerant system. As the temperature approaches the upper limit $L_U$, the suction valve 34 is cycled at a higher rate, which should reduce the relevant temperature $T_C$ to bring it closer to the target temperature value $L_O$. It should be noted that the extremely high cycling rate might be limited by the suction valve reliability and secondary instability effects propagating through the refrigerant system 20. Sometimes, it might also be desirable to maintain the temperature above a certain preset value. In this case, the control will adjust the cycling rate to assure that the temperature does not drop below a certain specified temperature. This may occur, for example, as the temperature of the compressor oil in the oil sump 52 needs to be maintained above a certain value to assure that the oil viscosity is not increased above a certain threshold that might be detrimental to oil delivery to the compressor components. In other instances, the control may adjust the cycling rate so that the peak-to-peak value of temperature fluctuations stays within a certain range. This might be desirable when the component damage may occur due to high fluctuations from a low to high temperature, causing thermal fatigue.

As can be appreciated from FIG. 2, in a region "X" of a temperature graph, the measured temperature $T_C$ is approaching the upper limit $L_U$. A duty cycle, or the time over which the peaks "P" and valleys "V" have existed as the valve is opened and closed, is relatively long. However, when the control 35 senses that the temperature is about to become excessively high or rising at an unacceptably high rate to approach the upper limit value $L_U$ (as illustrated over region "X"), the duty cycle becomes more rapid (cycle time is reduced) such that the valve stays open and closed over shorter time intervals. By reducing the cycle time $t_{CYCLE}$, over which the valve is opened and closed, the lower peak temperature is achieved, and the temperature trend is reversed, to move away from the specified upper threshold $L_U$, as is illustrated downstream of the region "X" on the graph. The present invention thus achieves suction valve control with a pulse width modulation signal, while addressing the temperature concerns set forth above. It has to be noticed that the capacity provided by the refrigerant system 20 is predominantly controlled by the ratio of time intervals over which the valve remains in the open and closed positions, and is practically independent of the cycling rate. Therefore, the refrigerant system capacity is not affected and controlled independently.

Further, the cycling rate can be also adjusted based upon operating conditions, allowable temperature and humidity variations within a conditioned environment, reliability limitations of the suction valve, refrigerant system efficiency goals, system thermal inertia, and operation stability and functionality considerations.

In another feature, the control can be an adaptive control that "remembers" changes in the duty cycle, which have been provided in the past, and the resultant changes in temperature. Thus, the control can "learn" over time to better control the temperature, and to result in a pulse width operation at the temperatures that are at desired levels. The control also can hunt for the best way to cycle the pulse width modulated valve by trying different cycling rates to establish which cycle rate would produce the best results within the imposed constraints, for example, on the maximum cycling rate of the valve.

Further, the pulse width modulated suction valve may have open and closed states corresponding to not necessarily fully open and fully closed positions, which provides additional flexibility in system control and operation. Additionally, if the temperature cannot be brought within the acceptable limits by reducing the cycle time as described above, then the length of time when the valve remains in the closed positions can be reduced (while maintaining the same time when the valve remains in the open position). In this case, the unit will produce more capacity than required to cool the conditioned environment to a preset level, thus some amount of unit cycling (completely turning off the compressor) may be necessary to precisely match delivered and required capacity.

Pulse width modulation controls are known, and valves operated by the pulse width modulation signal are known. The present invention utilizes this known technology in a unique manner to achieve goals and benefits as set forth above. Further, while temperature values are mentioned and are associated with the compressor, other measured parameters (e.g. current, power draw, etc.) may be indicative of the actual temperatures within the compressor. For example, the temperature within the compressor can be computed indirectly, based on the knowledge of other measured parameters such as suction and discharge pressure, voltage, etc. For purposes of this application, these parameters will still be within the scope of the claims for controlling the operation of the suction valve 34 to control temperature at desired locations within or outside of the compressor.

Although FIG. 1 illustrates a scroll compressor, the invention extends to other type of compressors, including (but not limited to) screw compressors, rotary compressors and reciprocating compressors. This invention can also be applied to a broad range of air conditioning systems, heat pump systems and refrigeration systems. Examples of such systems include room air conditioners, residential air conditioning and heat pump installations, commercial air conditioning and heat pump systems and refrigeration systems for supermarkets, container, and truck trailer applications.

Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. A refrigerant system comprising:

a compressor, a condenser positioned downstream of said compressor, an expansion device positioned downstream of said condenser and an evaporator positioned downstream of said expansion device;

a suction pulse width modulation valve positioned between said evaporator and said compressor; and a control for selectively operating said suction pulse width modulation valve to deliver refrigerant to said compressor, said control being operable to utilize a pulse width modulation signal to operate the suction pulse width modulation valve, and a duty cycle of said pulse width modulation signal being adjusted to control a temperature indicative of the compressor temperature, and said duty cycle of said suction pulse width modulation valve being changed to change the amount of refrigerant passing from said evaporator downstream into said compressor.

2. The refrigerant system as set forth in claim 1, wherein said temperature is a sensed temperature.

3. The refrigerant system as set forth in claim 1, wherein said temperature is a calculated temperature based on other parameters sensed in the refrigerant system.

4. The refrigerant system as set forth in claim 1, wherein said compressor is a motor driven compressor.

5. The refrigerant system as set forth in claim 4, wherein said temperature is measured at said motor.

6. The refrigerant system as set forth in claim 5 wherein said temperature is the temperature of refrigerant surrounding said motor.

7. The refrigerant system as set forth in claim 1, wherein said temperature is with the temperature of a refrigerant or compressor discharge.

8. The refrigerant system as set forth in claim 1, wherein said temperature is measured at a compressor pump unit.

9. The refrigerant system as set forth in claim 8 wherein said temperature is a refrigerant temperature inside said compressor pump unit.

10. The refrigerant system as set forth in claim 1, wherein an upper limit is set for said temperature, and a control monitors said temperature and compares it to said upper limit, and said control adjusting said duty cycle of said suction pulse width modulation valve to ensure that said temperature is maintained below said upper limit.

11. The refrigerant system as set forth in claim 1, wherein a lower limit is set for said temperature, and a control monitors said temperature and compares it to said lower limit, and said control adjusting said duty cycle of said suction pulse width modulation valve to ensure that said temperature is maintained above said lower limit.

12. A refrigerant system comprising:

a compressor, a condenser positioned downstream of said compressor, an expansion device positioned downstream of said condenser and an evaporator positioned downstream of said expansion device;

a suction pulse width modulation valve positioned between said evaporator and said compressor;

a control for selectively operating said suction pulse width modulation valve to deliver refrigerant to said compressor, said control being operable to utilize a pulse width modulation signal to operate the suction pulse width modulation valve, and a duty cycle of said pulse width modulation signal being adjusted to control a temperature indicative of the compressor temperature; and an upper limit being set for a temperature difference between high and low temperatures, and a control monitoring said temperature difference and comparing it to said upper limit, and said control adjusting said duty cycle of said suction pulse width modulation valve to ensure that said temperature difference is maintained below said upper limit.

13. The refrigerant system as set forth in claim 1, wherein said compressor is a sealed compressor having a housing incorporating said compressor motor and a compressor pump unit, and a suction line accepting refrigerant from said evaporator upstream to said compressor, refrigerant passing from said suction line into said sealed compressor housing, and over said compressor motor to cool said compressor motor.

14. A refrigerant system comprising:

a compressor, a condenser positioned downstream of said compressor, an expansion device positioned downstream of said condenser and an evaporator positioned downstream of said expansion device; and said compressor having a sealed housing sealing a compressor pump unit and an electric motor for driving a portion of said compressor pump unit, a control for receiving a temperature indicative of said compressor temperature, and a suction valve positioned between said evaporator and said compressor; and a control being operable to utilize a pulse width modulation signal to operate the suction valve, and a duty cycle of said pulse width modulation signal being controlled in combination with a compressor temperature to ensure that said compressor temperature does not violate a predetermined limit, and said duty cycle being changed to change the amount of refrigerant passing from said evaporator downstream into said compressor.

15. The refrigerant system as set forth in claim 14 wherein said temperature is the temperature of refrigerant surrounding said motor.

16. The refrigerant system as set forth in claim 14, wherein said temperature is with the temperature of a refrigerant or compressor discharge.

17. The refrigerant system as set forth in claim 14, wherein said temperature is measured at a compressor pump unit.

18. The refrigerant system as set forth in claim 14, wherein an upper limit is set for said temperature, and a control monitors said temperature and compares it to said upper limit, and said control adjusting said duty cycle of said suction pulse width modulation valve to ensure that said temperature is maintained below said upper limit.

19. The refrigerant system as set forth in claim 14, wherein when said temperature approaches said upper limit, said duty cycle is modified such that said valve is maintained closed for shorter periods of time.

20. The refrigerant system as set forth in claim 14, wherein when said temperature approaches said upper limit, said duty cycle is modified such that said valve is maintained open for longer periods of time.

* * * * *